United States Patent [19]

Creatura et al.

[11] Patent Number: 4,828,956

[45] Date of Patent: May 9, 1989

[54] PROCESSES FOR MAINTAINING THE TRIBOELECTRIC STABILITY OF ELECTROPHOTOGRAPHIC DEVELOPERS

[75] Inventors: John A. Creatura, Ontario; Deepak R. Maniar, Penfield, both of N.Y.

[73] Assignee: Xerox Corporation, Stamford, Conn.

[21] Appl. No.: 188,881

[22] Filed: May 2, 1988

[51] Int. Cl.[4] ..... G03G 9/08

[52] U.S. Cl. ..... 430/137; 222/DIG. 1

[58] Field of Search ..... 430/137; 222/DIG. 1

[56] References Cited

U.S. PATENT DOCUMENTS

| | | | |
|---|---|---|---|
| 3,970,571 | 7/1976 | Olson et al. | 430/137 |
| 4,264,697 | 4/1981 | Perez et al. | 430/137 X |
| 4,288,518 | 9/1981 | Miyamoto | 430/122 |
| 4,511,639 | 4/1985 | Knott et al. | 430/137 X |
| 4,537,850 | 8/1985 | Smeimar | 430/137 |
| 4,621,039 | 11/1986 | Ciccarelli et al. | 430/137 X |

*Primary Examiner*—Roland E. Martin

*Attorney, Agent, or Firm*—Judith L. Byorick

[57] ABSTRACT

A process for maintaining the triboelectric stability of an electrophotographic developer composition, comprising:

a. providing a first developer composition comprising first toner particles and virgin carrier particles;

b. determining the tribo product of said first developer composition;

c. providing an aged developer composition by subjecting said first developer composition to at least 5,000 electrophotographic imaging cycles, wherein the tribo product of said aged developer composition is from about 10 to about 200%·μC/g;

d. determining the tribo product of said aged developer composition;

e. providing a second developer composition comprising second toner particles and said virgin carrier particles;

f. incorporating said second developer composition into an electrophotographic imaging device; and g. adding said first toner particles to said device as said second toner particles are depleted by image development; subject to the provision that the tribo product of said first developer composition is unequal to the tribo product of said second developer composition, and the tribo product of said first developer composition and the tribo product of said second developer composition are from about 10 to about 200%·μC/g.

26 Claims, 2 Drawing Sheets

PROCESSES FOR MAINTAINING THE TRIBOELECTRIC STABILITY OF ELECTROPHOTOGRAPHIC DEVELOPERS

BACKGROUND OF THE INVENTION

The present invention is directed to electrophotographic processes. More specifically, the present invention is directed to processes for maintaining the triboelectric stability of electrophotographic developers. In one embodiment, the present invention comprises an electrophotographic process wherein the triboelectric charging characteristics of the developer remain stable from initial use through an extended time period, with no need for mechanical preconditioning or subsequent monitoring and adjustment.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Many methods are known for applying the electroscopic particles to the electrostatic latent image to be developed. One development method, disclosed in U.S. Pat. No. 2,618,552, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Often, when new developer is added to an electrophotographic imaging system, the triboelectric charging characteristics of the developer are unstable for a number of imaging cycles and reach a stable equilibrium only after a period of time. Typically, either the triboelectric charging value of the developer initially rises and then falls, finally reaching a point of equilibrium lower than the initial value, or the triboelectric charging value rises with time and reaches a point of equilibrium higher than the initial value. This initial instability usually results in disadvantages such as poor quality images for the first series of imaging cycles performed with the new developer, deterioration of image quality after a number of imaging cycles, the necessity for machine adjustment after the developer has been installed (incorporated) and has been in use for a period of time, or any combination of these problems. Accordingly, elimination of the initial instability of the triboelectric characteristics of new developers would reduce or eliminate the aforementioned difficulties. The process of the present invention overcomes this problem.

Attempts have been made to solve the problem of initial triboelectric instability of electrophotographic developers. One such solution entails mechanical preconditioning of the developer prior to use in order to simulate aging. The developer is agitated mechanically for a period of time such that the surfaces of the carrier particles become abraded. The process simulates the aging process that occurs through normal usage of the developer. Abrasion of the carrier surfaces is believed to be a contributing factor to the initial instability with respect to triboelectric characteristics often observed for new developers.

Mechanical preconditioning methods are disclosed in U.S. Pat. No. 3,970,571, which is directed to a method for preparing a preconditioned dry electrographic developer wherein the carrier particles are initially mixed with resin-based toner particles having a higher than usual concentration of a charge control agent, such as approximately 2 to 24 percent by weight. This initial mixing occurs by tumbling in a rotating container, and continues for a period sufficient to pack the carrier pores with toner particles, scum the carrier surfaces with the charge control agent, and abrade the carrier surfaces. After this process, resin-based toner particles having the charge control agent present in the amount desired in the final developer composition, such as approximately 1 percent by weight, are added to the developer. Thus, this process entails preconditioning of the developer for a period of time before its use in an imaging device.

Another potential solution to the problem of initial triboelectric instability resides in adjusting the development system after a number of imaging cycles, as disclosed in U.S. Pat. No. 4,288,518, which is directed to a method for addressing the problem of spent toner and eliminating the need to dispose of and replace developer after 10,000 to 20,000 imaging cycles. The method entails replenishing the developer composition with toner particles that, when mixed with the carrier of the initial developer composition, result in a developer differing in triboelectric charging characteristics from the initial developer. If the developer deterioration has resulted in images of increased image density, which is caused by a drop in triboelectric chargeability of the developer, the developer is replenished with new toner that will result in a developer having a lower chargeability than the initial developer. Conversely, if the developer deterioration has resulted in images of decreased image density, which is caused by a rise in triboelectric chargeability of the developer, the developer is replenished with new toner that will result in a developer having a higher chargeability than the initial developer. Replenishment according to this method may be delayed until after repeated use of the developer and replenishment with the original toner composition. This process requires adjustment of the development system after its initial installment by diagnosing a developer malfunction and replenishing the used developer with a toner having the necessary characteristics. In contrast, the present invention entails installing a fresh, unused developer package containing "start-up" toner in an imaging device and providing a replenishment package of "dispense" toner. This "dispense" toner is added to the developer gradually, as necessary to replenish the supply of toner in the development housing throughout the life of the developer, and no subsequent adjustments to the development system are necessary.

European Patent Application No. 248-119-A discloses a process wherein electrostatic images are developed using a developer comprising charged toner and carrier particles. During use, the toner particles are replenished with particles which have the same composition as the particles used initially, but have a larger mean particle diameter. The apparent density of the initial developer and the replenished developer does not differ by more than 10 percent.

Although the prior art processes are suitable for their intended purposes, they possess a number of disadvantages. For example, a mechanical preconditioning process constitutes an additional cost to the manufacturing process because of the required additional time and handling. In addition, mechanical preconditioning also abrades the carrier surfaces such that a large amount of carrier attrition occurs during the process. The small carrier pieces created by the abrasion can mix with the toner and ultimately become part of the developed image. These carrier pieces may adversely affect copy quality, especially when colored toners are used, since the pieces become trapped and fused with the toner and result in speckled images. Disadvantages also exist for a process involving the use of a developer until image quality deteriorates and subsequent replenishment of the used developer with a different toner selected according to the nature of the image deterioration, in that the process requiers monitoring of image quality during the lifetime of the developer and results in additional service costs. Accordingly, a need continues to exist for a process for eliminating initial triboelectric instability in developer compositions that requires no mechanical preconditioning or subsequent monitoring and maintenance.

SUMMARY OF THE INVENTION

It is an object of the present invention to provide processes that overcome many of the above noted disadvantages.

It is another object of the present invention to provide a process for stabilizing the triboelectric characteristics of an electrophotographic developer composition.

Another object of the present invention is to provide a means for stabilizing the triboelectric characteristics of a developer composition that entails no mechanical preconditioning of the developer.

Still another object of the present invention is to provide a means for stabilizing the triboelectric characteristics of a developer composition that enables the production of high quality colored images.

Yet another object of the present invention resides in providing a means for stabilizing the triboelectric characteristics of a developer composition that requires no monitoring of the triboelectric characteristics of the developer after its installation.

It is still another object of the present invention to provide a process for stabilizing the triboelectric characteristics of a developer composition wherein no additional servicing of the electrostatographic imaging device is required to maintain the triboelectric stability during the period following installation of the new developer.

Another object of the present invention resides in providing a means for stabilizing the triboelectric characteristics of a developer composition that permits uniformly high copy quality during the transition period between installment of new developer and aging of the developer to a degree that the triboelectric characteristics thereof remain relatively stable.

Yet another object of the present invention resides in providing a means for stabilizing the triboelectric characteristics of a new developer composition that improves copy quantity by eliminating carrier fragments in the developer caused by a mechanical preconditioning process.

Still another object of the present invention resides in providing a means for stabilizing the triboelectric characteristics of a new developer composition that reduces developer manufacturing time and expense by eliminating the need for mechanical preconditioning.

These and other objects of the present invention are achieved by providing processes for maintaining the triboelectrical stability of an electrophotographic developer. One embodiment of the process comprises (a) determining the tribo product of a first developer composition comprising first toner particles and unused or virgin carrier particles, (b) providing an aged developer composition by subjecting the first developer composition to at least 5,000 electrophotographic imaging cycles, wherein the tribo product of the aged developer composition is from about 10 to about 200%·$\mu$C/g; (c) determining the tribo product of the aged developer composition, (d) providing a second developer composition comprising second toner particles and the unused carrier particles; (e) incorporating the second developer composition into an electrophotographic imaging device; and (f) as the second toner particles are depleted by image development, adding the first toner particles to the device; wherein the tribo product of the first developer composition is unequal to the tribo product of the second developer composition, subject to the provision that the tribo product of the first developer composition and the tribo product of the second developer composition are from about 10 to about 200%·$\mu$C/g. The process of the present invention provides a developer composition having stable triboelectric charging characteristics beginning with its initial use and continuing for the life of the developer, and this result is achieved without the need for mechanical preconditioning or monitoring and maintenance subsequent to installment of the developer.

For the purposes of the present invention, the terms "virgin" or "unused", as applied to carrier particles, means that the carrier particles are in a condition that approximates the condition of new particles that have never been subjected to imaging cycles and have never been preconditioned. Virgin or unused carrier particles thus have not undergone any significant degree of abrasion, have not had their surfaces scummed with toner components, have not become impacted with toner particles, and otherwise possess the characteristics of new, previously unused carrier particles.

DETAILED DESCRIPTION OF THE INVENTION

Figure 1:
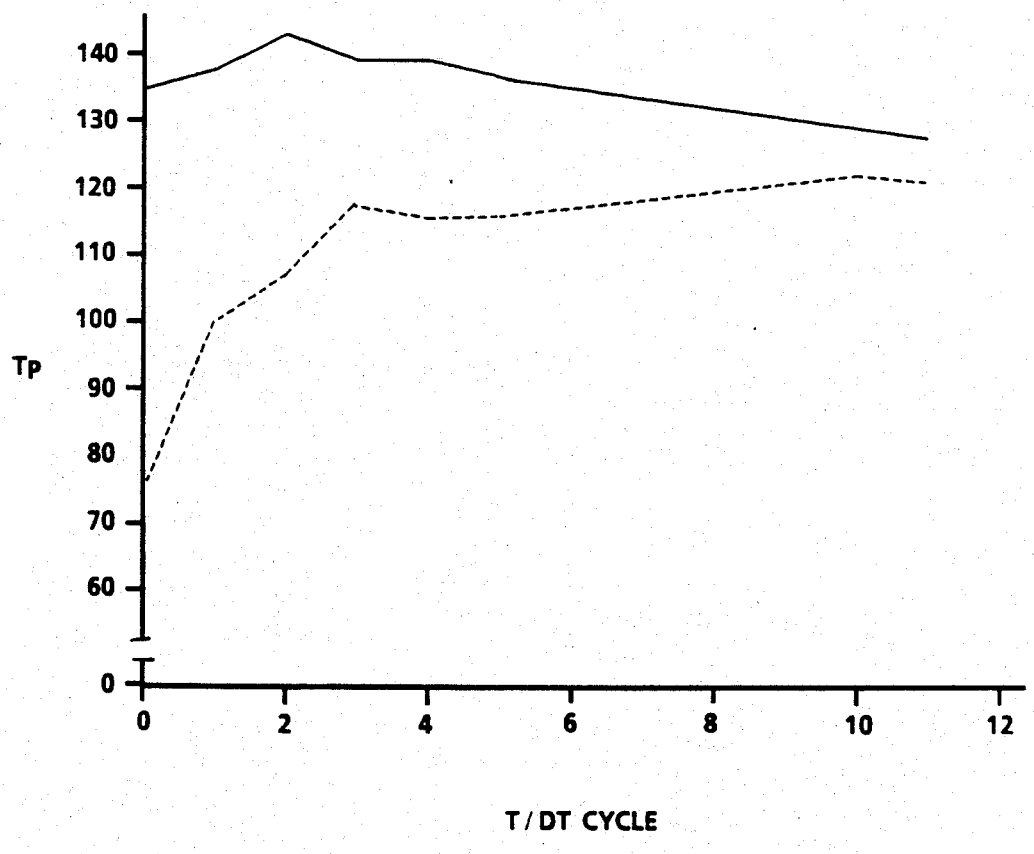
FIG. 1 illustrates comparative data generated as described in Example I herein. The data indicate that the process of the present invention enables significant stabilization of the triboelectric characteristics of a new developer in situations where the developer's charging characteristics tend to rise during use.

During the process of the present invention, the triboelectric charging characteristics of the developer composition intended for use in the imaging device are determined. These values will differ, depending on the nature of the materials selected for the developer composition and the type of electrophotographic imaging device into which the developer is incorporated, and may be determined by any suitable method. For example, the developer composition may be incorporated in a test electrophotographic imaging device and the device may be activated through a number of imaging cycles, during which period the triboelectric characteristics of the developer composition are monitored, until a state of equilibrium is achieved. Generally, developer compositions reach triboelectrical equilibrium after from about 5,000 to about 20,000 imaging cycles. Alternatively, a sample of the developer composition may be mechanically aged by a process known as "tone-detone aging." This process emulates the activity within an electrostatic imaging device during normal usage, and entails: (1) measuring the tribo value (microcoulombs per gram) and the toner concentration of the unused developer prior to use, and calculating the tribo product for cycle number equals 0 by multiplying tribo by toner concentration, (2) placing the developer sample in a bottle and agitating it in a paint shaker for about 10 minutes, (3) removing the developer from the bottle, detoning the developer by removing the toner particles therefrom, and adding fresh toner to the developer at the desired toner concentration, (4) placing the developer sample in a bottle and agitating it in a paint shaker for about 10 minutes; (5) measuring the tribo and the toner concentration of the developer and calculating the tribo product for the developer at cycle number equals 1; repeating steps (3) through (5) for any desired number of cycles, usually until the tribo product values become relatively stable; and (7) plotting the values for tribo product versus cycle number. The triboelectric characteristics of the final developer composition can be determined after the aging process by examining the plot of tribo product versus cycle number, since after a number of cycles, the tribo product will stabilize and remain relatively uniform. Typically, a plot of tribo product versus cycle number will either resemble Plot A, below, in the situation wherein the tribo of the new developer tends to initially rise and then fall to a level below the start-up value, or resemble Plot B, below, in the situation wherein the tribo of the new developer tends to rise to a level above that of the start-up value.

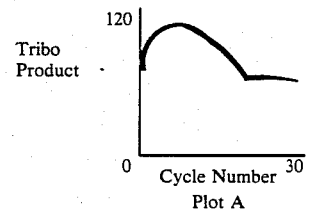

Plot A

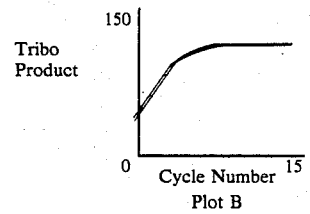

Plot B

Any other means by which the desired characteristics of the final developer composition may be determined are also suitable for use in conjunction with the invention. Thus, triboelectric charge may be determined by known methods, such as the use of a Faraday cage apparatus and a blow-off process.

The developer compositions selected for the process of the present invention comprise toner particles and carrier particles. Suitable toner particles may be of any composition suitable for development of electrostatic latent images, such as those comprising a resin and a colorant. Various toner resins are suitable for the present invention, such as polyesters, polyamides, epoxies, polyurethanes, diolefins, vinyl resins and polymeric esterification products of a dicarboxylic acid and a diol comprising a diphenol. Typical vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl esters, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; polyolefins, such as styrene butadienes, especially those available as Pliolites, and mixtures of these monomers. The resins are generally present in an amount of from about 30 to 99 percent by weight of the toner composition, although they may be present in greater or lesser amounts, provided that the objectives of the invention are achieved.

Suitable pigments or dyes selected as colorants for the toner particles include carbon black, nigrosine dye, aniline blue, magnetites, and mixtures thereof, with carbon black being the preferred colorant. The pigment should be present in an amount sufficient to render the toner composition highly coloed to permit the formation of a clearly visible image on a recording member. Generally, the pigment particles are present in amounts from about 1 percent by weight to about 20 percent by weight based on the total weight of the toner composition; however, lesser or greater amounts of pigment particles may be present provided that the objectives of the present invention are achieved.

When the pigment particles are magnetites, which comprise a mixture of iron oxides ($Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight, although they may be present in greater or lesser amounts, provided that the objectives of the invention are achieved.

Colored toner pigments are also suitable for use with the present invention, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as C.I. 60710, C.I. Dispersed Red 15, a diazo dye identified in the color index as C.I. 26050, C.I. Solvent Red 19, and the like. Illustrative examples of suitable cyan pigments include copper tetra-4-(octadecyl sulfonamido) phthalocyanine, copper phthalocyanine pigment, listed in the color index as C.I. 74160, Pigment Blue, and Anthradanthrene Blue, identified in the color index as C.I. 69810, Special Blue X-2137, and the like. Illustrative examples of yellow pigments that may be selected include diarylide yellow 3,3-dichlorobenzidene acetoacetanilides, a monoazo pigment identified in the color index as C.I. 12700, C.I. Solvent Yellow 16, a nitrophenyl amine sulfonamide identified in the color index as Foron Yellow SE/GLN, C.I. Dispersed Yellow 33, 2,5-dimethoxy-4-sulfonanilide phenylazo-4'-chloro-2,5-dimethoxy aceto-acetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoescht), Permanennt Yellow YE 0305 (Paul Uhlich), Lumogen Yellow D0790 (BASF), Suco-Gelb L1250 (BASF), Suco-Yellow D1355 (BASF), Hostaperm Pink E (American Heochst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments are generally present in an amount of from about 15 weight percent to about 20.5 weight percent based on the weight of the toner resin particles, although lesser or greater amounts may be present provided that the objectives of the present invention are met.

External additives may also be present in the above described toners in instances such as when toner flow is to be assisted, or when lubrication is desired to assist a function such as cleaning of the photoreceptor. The amounts of external additives are measured in terms of percentage by weight of the toner composition. For example, a toner composition containing a resin, a pigment, and an external additive may comprise 80 percent by weight resin and 20 percent by weight pigment, and may also comprise 0.2 percent by weight of an external additive. External additives may include any additives suitable for use in electrostatographic toners, including fumed silica, silicon derivatives such as Aerosil R972®, available from Degussa, Inc., ferric oxide, hydroxy terminated polyethylenes such as Unilin, polyolefin waxes, polymethylmethacrylate, zinc stearate, chromium oxide, aluminum oxide, titanium oxide, stearic acid, polyvinylidene fluorides such as Kynar®, and other known or suitable additives. External additives may be present in various effective amounts, provided that the objectives of the present invention are achieved. Preferably, external additives are present in an amount of from about 0.1 to about 4 percent by weight, and more preferably from about 0.5 to about 1 percent by weight.

The toner compositions may be prepared by any suitable method. For example, a method known as spray drying entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a pigmented resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size. A third suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size. Other similar blending methods may also be used. Subsequent to size classification of the toner particles, any external additives are blended with the toner particles. The resulting toner composition is then mixed with carrier particles such that the toner is present in an amount of about 1 to about 4 percent by weight of the carrier, and preferably about 3 percent by weight of the carrier, although different toner to carrier ratios are acceptable, provided that the objectives of the present invention are achieved.

Carrier particles selected for the process of the invention may be chosen from a number of known materials, provided that the objectives of the invention are achieved. Illustrative examples of suitable carrier particles include granular zircon, steel, nickel, iron, ferrites, and the like. Other suitable carrier particles include nickel berry carriers as disclosed in U.S. Pat. No. 3,847,604, the disclosure of which is totally incorporated herein by reference. These carriers comprise nodular carrier beads of nickel characterized by surfaces of reoccurring recesses and protrusions that provide the particles with a relatively large external area. The diameters of the carrier particles may vary, but are generally from about 50 microns to about 1,000 microns, thus allowing the particles to possess sufficient density and inertia to avoid adherence to the electrostatic images during the development process.

The carrier particles may possess coated surfaces. Coating materials include polymers and terpolymers, including fluoropolymers as disclosed in U.S. Pat. Nos. 3,526,533; 3,849,186; and 3,942,979, the disclosures of which are totally incorporated herein by reference. Specific examples of carrier coatings include polyvinylidene fluoride, polymethylmethacrylate, and mixtures thereof. Preferably, carrier coatings are present in an amount of from about 0.1 to about 1 percent by weight of the uncoated carrier particle, although other amounts are suitable provided that the objectives of the present invention are achieved.

Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved.

The process of the present invention also entails the preparation of a start-up developer composition containing carrier particles identical to those of the developer composition intended for use in the imaging device, and toner particles that will result in the start-up developer having triboelectric charging characteristics different from the aforesaid developer composition. In order to maintain uniformity of performance as the regular toner gradually replaces the start-up toner in the imaging device, the composition of the toner particles of the start-up developer composition, referred to hereinafter as "second toner particles", should resemble the toner particles of the regular developer composition, referred to hereinafter as "first toner particles", as nearly as possible. To achieve this end, second start-up toner particles may be prepared by repeating the composition of the first toner particles and adjusting either or both to alter their triboelectric charging characteristics when combined with the selected carrier.

Several methods exist for altering the triboelectric charging characteristics of a developer composition. For example, charge control agents may be added as external additives to the second start-up toner composition, the first toner composition, or both. Typical charge control agents include cetyl pyridinium chloride, distearyl dimethyl ammonium methyl sulfate, and the like. Additional examples of suitable charge control additives are disclosed in U.S. Pat. Nos. 4,560,635 and 4,294,904, the disclosures of each of which are totally incorporated herein by reference. In addition, the concentration of a charge control agent may be varied between two different toners in order to produce two developer compositions having different triboelectric charging characteristics. Preferably, charge control agents are present in an amount of from about 0.1 to about 4 percent by weight, and more preferably from about 0.5 to about 1 percent by weight.

Another method of adjusting triboelectric charging characteristics of a developer composition entails varying the toner particle diameter. In general, a larger toner particle diameter results in a smaller value for the triboelectric charge of the developer. The exact relationship between triboelectric charge and particle diameter varies with the composition of the toner particles. For example, for a toner comprising poly-n-butylmethacrylate with an average molecular weight of about 68,000, present in an amount of about 92 percent by weight, Regal® 330 carbon black, present in an amount of about 6 percent by weight, and cetyl pyridinium chloride, present in an amount of about 2 percent by weight, the triboelectric charge on the toner particles decreases by approximately 2 to 3 microcoulombs per gram for every increase of 1 micron in average particle diameter within the standard diameter range of 3 to 20 microns.

Triboelectric charging characteristics of a developer may also be adjusted by means of external additives. Although external additives are normally added for the purpose of improving flow characteristics of the dry toner powder, they also effect the triboelectric charge of the developer. In principle, most external additives will affect tribo; the direction and magnitude of the effect on tribo product resulting from addition of an external additive is specific to the materials chosen. For example, addition of 3 grams of ferric oxide to 97 grams of a toner comprising about 92 percent by weight of a poly-n-butylmethacrylate resin with an average molecular weight of about 68,000, about 6 percent by weight of Regal® 330 carbon black, and about 2 percent by weight of cetyl pyridinium chloride will drop the tribo product of a developer about 30 units, from 86 to 56, said developer comprising about 3 percent by weight of the toner and about 97 percent by weight of carrier particles having a steel core having a coating comprising about 60 percent by weight of polymethylmethacrylate and about 40 percent by weight of polyvinylidene fluoride, and having a nominal weight median particle diameter of about 125 microns, with the coating comprising about 0.7 percent by weight of the carrier particles. Addition of 0.3 gram of Aerosil® R972 colloidal silica to 97.7 grams of a toner comprising about 77.5 percent by weight of a styrene-butadiene resin, wherein the styrene is present in an amount of about 88 percent by weight of the resin and the butadiene is present in an amount of about 12 percent of the resin, about 4 percent by weight of Regal® 330 carbon black, about 18 percent by weight of Mapico Black, and about 0.5 percent by weight of distearyl dimethyl ammonium methyl sulfate will drop the tribo product of a developer about 30 units, from 90 to 60, said developer comprising about 3 percent by weight of the toner and about 97 percent by weight of carrier particles comprising an atomized steel core having a coating comprising about 0.42 percent by weight of the uncoated carrier particle of polymethylmethacrylate and about 0.28 percent by weight of the uncoated carrier particle of Kynar® 301-F polyvinylidene fluoride and having a nominal weight median particle diameter of about 130 microns, with the coating comprising about 0.7 percent by weight of the carrier particles. Addition of 0.4 gram of a hydroxy terminated polyethylene, commercially available as Unilin, to 99.6 grams of a toner comprising about 77.5 percent by weight of a styrenebutadiene resin, wherein the styrene is present in an amount of about 88 percent by weight of the resin and the butadiene is present in an amount of about 12 percent of the resin, about 4 percent by weight of Regal® 330 carbon black, about 18 percent by weight of Mapico Black, and about 0.5 percent by weight of distearyl dimethyl ammonium methyl sulfate will raise the tribo product of a developer about 3 units, from 57 to 60, said developer comprising about 3 percent by weight of the toner and about 97 percent by weight of carrier particles comprising an atomized steel core having a coating comprising about 0.42 percent by weight of the uncoated carrier particle of polymethylmethacrylate and about 0.28 percent by weight of the uncoated carrier particle of Kynar® 301-F polyvinylidene fluoride and having a nominal weight median particle diameter of about 130 microns, with the coating comprising about 0.7 percent by weight of the carrier particles.

The triboelectric charging characteristics of developers may also be adjusted by combining the methods described above or by varying other factors, such as the method of mixing and preparing the developer components. Examples of how mixing variables can affect tribo are disclosed in U.S. Pat. No. 4,264,697, the disclosure of which is totally incorporated herein by reference.

Typically, initial instability of the triboelectric charging characteristics of new developer manifests itself in one of two ways. In the first instance, referred to hereinafter as the high-to-low situation, the triboelectric charge of the developer initially rises and then falls, finally reaching a point of equilibrium lower than the initial value. In the second instance, referred to hereinafter as the low-to-high situation, the triboelectric charge rises with time and reaches a point of equilibrium higher than the initial value. For the high-to-low situation, the developer containing the start-up toner particles has lower triboelectric charging characteristics than the developer containing the dispense toner particles. For the low-to-high situation, the developer containing the start-up toner particles has higher triboelectric charging characteristics than the developer containing the first, dispense toner particles.

In one embodiment, the process of the present invention can be implemented by providing the user of an electrophotographic imaging device with a new developer composition containing the second start-up toner. When enough of the second start-up toner has been consumed to necessitate replenishing of the toner supply, the first toner is added to the development housing in the usual manner. Ordinarily, such replenishment occurs automatically by means of machine control logic. Toner provided to the user for replenishment purposes has the composition of the regular, first toner, and not that of the second start-up toner, which is used solely in combination with new developer and is never added to a developer composition that has been in use. Gradually, as the toner supply is replenished repeatedly, the first tone completely replaces the second start-up toner in the development housing, until the developer composition in the development housing becomes identical to the first developer composition.

The start-up second toner can be chosen such that a developer comprising the second start-up toner and the chosen carrier possesses a tribo product approximately equal to that which would be observed for the first developer composition after it had passed through the initial period of instability and reached equilibrium. For example, for a first developer composition that typically exhibits an initial rise in tribo product followed by a drop, such that the tribo product levels off at a value lower than that of the developer when it is new, the start-up second developer would exhibit a tribo product lower than that of the first developer and approximately equal to the value at which the tribo product of the first developer leveled off after an extended number of imaging cycles. Likewise, for a first developer composition that typically exhibits a rise in tribo product, such that the tribo product levels off at a value higher than that of the developer when it is new, the start-up developer would exhibit a tribo product higher than that of the first developer and approximately equal to the value at which the tribo product of the first developer leveled off after an extended number of imaging cycles. With respect to the start-up developer exhibiting a tribo product "approximately equal to the value at which the tribo product of the first developer leveled off after an extended number of imaging cycles," the tribo product of the start-up developer may be within 25, and preferably within 5, tribo product units of the tribo product of the first developer after it has reached equilibrium. In one preferred embodiment, the tribo product of the second developer composition has a tribo product of from about 130 to about 140%·μC/g and the first developer composition has a tribo product of from about 70 to about 80%·μC/g. In another preferred embodiment, the second developer composition has a tribo product of from about 47 to about 57%·μC/g and the first developer composition has a tribo product of from about 70 to about 80%·μC/g.

In addition, the second start-up developer composition should be one that, if used alone, would exhibit an initial instability opposite to that of the first, regular developer composition. For example, if the regular, first developer typically exhibits an initial rise in tribo product followed by a drop, such that the tribo product levels off at a value lower than that of the developer when it is new, the start-up second developer should be one that typically exhibits a rise in tribo product during use, such that the tribo product levels off at a value higher than that of the second developer when it is new. Similarly, if the regular, first developer composition typically exhibits a rise in tribo product, such that the tribo product levels off at a value higher than that of the developer when it is new, the start up second developer should be one that typically exhibits during use an initial rise in tribo product followed by a drop, such that the tribo product levels off at a value lower than that of the second developer when it is new. Ideally, if the tribo products of the first and second developer compositions were measured when the developers were unused and measured again after several tone-detone cycles to simulate developer aging, and the tribo product values for each were plotted against the number of tone-detone cycles, the slope of the line formed by the points plotted for the first developer should be equal to and opposite in sign to the slope of the line formed by the points plotted for the second developer.

The following examples are illustrative in nature and are not intended to limit the scope of the invention. Other embodiments may occur to those skilled in the art. For all of the following examples, triboelectric charging characteristics of the various particles are reported in terms of tribo product, a value obtained according to the following formula:

$$TP = T_c \times \text{tribo}$$

where:

TP = tribo product (%·μC/g)

$T_c$ = toner concentration in developer by weight percent (%)

tribo = triboelectric charge on toner (microcoulombs per gram)

EXAMPLE 1

Low-To-High Situation

A first developer composition, present as a control for comparison purposes, was prepared which contained carrier particles having a steel core coated with a homogeneous blend of about 60 percent by weight of polymethylmethacrylate, available from Soken Chemical Corp. of Japan, and about 40 percent by weight of Kynar® 301-F polyvinylidene fluoride. The carrier particles had a nominal weight median particle diameter of about 125 microns, with the coating comprising about 0.7 percent by weight of the carrier particles. Toner particles were prepared by extrusion comprising about 77.5 percent by weight of a styrene-butadiene resin wherein the styrene is present in an amount of about 88 percent by weight of the resin and the butadiene is present in an amount of about 12 percent of the resin, about 4 percent by weight of Regal® 330 carbon black, about 18 percent by weight of Mapico Black, and about 0.5 percent by weight of the charge enhancing additive, distearyl dimethyl ammonium methyl sulfate, and having an average particle diameter of 9 microns were mixed with the carrier particles in a high intensity Lodige blender for about 10 minutes to result in a developer composition comprising about 4 percent by weight of the toner particles and about 96 percent by weight of the carrier which developed exhibiting a tribo product of about 75.

A second experimental developer was then prepared with carrier particles identical to those present in the first developer. With the carrier particles there were then mixed toner particles with an average diameter of 9 microns comprising about 77 percent by weight of a styrene-butadiene resin wherein the styrene is present in an amount of about 88 percent by weight of the resin and the butadiene is present in an amount of about 12 percent of the resin, about 4 percent by weight of Regal® 330 carbon black, about 18 percent by weight of Mapico Black, and about 1 percent by weight of distearyl dimethyl ammonium methyl sulfate. The toner and carrier particles were mixed in a high intensity Lodige blender for about 10 minutes to result in a developer composition comprising about 4 percent by weight of the toner particles and about 96 percent by weight of the carrier particles, and exhibiting a tribo product of about 132.

Both of the above prepared developers were treated according to the paint shaker tone/detone surrogate aging method, a method designed to simulate the aging process that occurs for developers during normal use in an electrophotographic imaging device. Specifically, the developers were introduced into two separate bottles, and the bottles placed in a paint shaker for a ten minute cycle. After the ten minute cycle, the toner particles were removed from the bottles and new toner particles were mixed with the carrier particles in the bottles. The first, or control, developer was replenished with toner particles identical in composition to those initially present. The second, or experimental, developer was replenished with a mixture of toner particles identical to those initially present in the second developer and toner particles identical to those initially present in the first developer. Both developers were subjected to a repeated number of ten minute cycles in the paint shaker, each developer being detoned and replenished with new toner after each cycle.

The percentages of the two different toners present in the second, experimental developer composition were varied after each cycle to simulate the gradual change in composition that the developer would undergo in an actual imaging device as start-up toner was consumed and gradually replaced by dispense toner. These percentages were determined according to a dilution calculation wherein one paint shaker tone/detone cycle is equivalent to 1000 imaging cycles in an actual xerographic imaging device and toner is consumed at the rate of one pound per 11,000 imaging cycles. Twelve pounds of the developer were used, and the toner concentration was 4.0 percent in Example I and 2.0 percent in Example II. The aforementioned conditions yield a dilution of the original toner of 70 percent (0.73) per cycle. According to the dilution calculation, which calculates the ratio of start-up toner to dispense toner, the percentages of each toner are as follows:

$$\% \text{ High Tribo Toner} = 100 \times 0.73^{(n-1)}$$

(n = paint shaker tone/detone cycle number)

$$\% \text{ Low Tribo Toner} = 100 - \% \text{ High Tribo Toner}$$

Thus, for example, before the first cycle, n = 1, and the percentage of high tribo toner present is 100. At this point, the developer composition contains only the carrier particles and the start-up high tribo toner. After one cycle and before the second cycle, n = 2 and the toner is replaced with a mixture of 73% high tribo toner and 27% low tribo toner. This developer composition simulates the situation in an actual imaging device after about 1000 copies, when 73% of the start-up toner is still present and 27% of the start-up toner has been consumed and replaced with dispense toner.

The triboelectric charging characteristics of both developers were monitored after each paint shaker tone/detone cycle, and the results are presented in FIG. 1. As indicated in this figure, the tribo product of the first (control) developer, represented by the dotted line, initially increased dramatically, rising from a tribo product of about 75 to at tribo product of about 115 during the first three cycles, and eventually reaching equilibrium at about 120. In contrast, the tribo product of the second (experimental) developer, represented by the solid line and illustrating developed obtained with the process of the present invention, initially increased only slightly, rising from about 132 to about 138, and reaching equilibrium at about 130. These results illustrate the improvement in initial operating stability obtained when the process of the present invention is applied with respect to fresh developer compositions in low-to-high situations.

EXAMPLE II

High-To-Low Situation

A first developer composition, present as a control for comparison purposes, was prepared which contained carrier particles having an atomized steel core coated with about 0.18 percent by weight of Kynar® 301-F polyvinylidene fluoride. The carrier particles had a nominal weight medium particle diameter of about 130 microns. Toner particles comprising about 92 percent by weight of a poly-n-butylmethacrylate resin with an average molecular weight of about 68,000, about 6 percent by weight of Regal® 330 carbon black, and about 2 percent by weight of cetyl pyridinium chloride, prepared by the extrusion process and having an average particle diameter of 11 microns were mixed with the carrier particles in a high intensity Lodige blender for about 10 minutes to result in a developer composition comprising about 3 percent by weight of the toner particles and about 97 percent by weight of the carrier particles.

A second experimental developer, present to illustrate the process of the present invention, was prepared having carrier particles identical to those present in the first developer. With the carrier particles were mixed toner particles having an average particle diameter of 11 microns and being of the same composition as the toner particles in the first developer with the exception that the toner contained 3 percent by weight of ferric oxide particles having an average diameter of less than 1 micron, present as an external additive for the purpose of adjusting the triboelectric charging characteristics of the toner. The toner and carrier particles were mixed in a high intensity Lodige blender for about 10 minutes to result in a developer composition comprising about 3 percent by weight of the toner particles and about 97 percent by weight of the carrier particles.

Both of the above developers were treated according to the paint shaker tone/detone surrogate aging method as described in Example I. The percentages of high tribo toner and low tribo toner present in the second (experimental) developer were determined according to the same dilution calculation as was used in Example I. Since the formula calculates the ratio of start-up toner to dispense toner, the high and low tribo toners appear reversed in the formula:

$$\% \text{ Low Tribo Toner} = 100 \times 0.73^{(n-1)}$$

(n = paint shaker tone/detone cycle number)

$$\% \text{ High Tribo Toner} = 100 - \% \text{ Low Tribo Toner}$$

Figure 2:
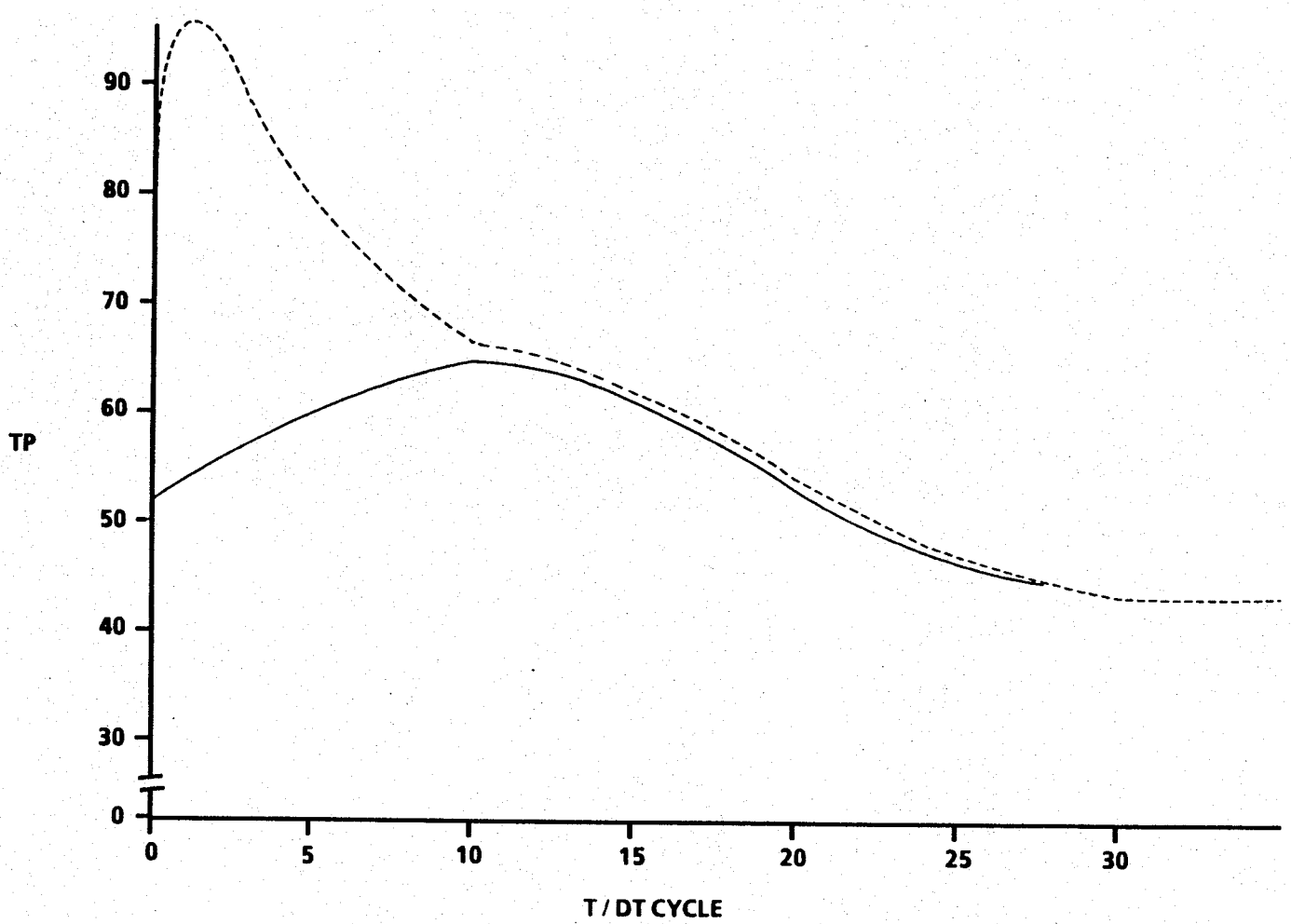
FIG. 2 illustrates comparative data generated as described in Example II herein. The data indicate that the process of the present invention enables significant stabilization of the triboelectric characteristics of a new developer in situations where the developer's charging characteristics tend initially to rise and then to fall during use.

The triboelectric charging characteristics of both developers were monitored after each paint shaker tone/detone cycle, and the results are presented in FIG. 2. As indicated in this figure, the tribo product of the first (control) developer, represented by the dotted line, initially increased, rising from about 85 to about 100 after the first cycle, and subsequently dropped significantly, eventually reaching equilibrium at about 45 in contrast, the tribo product of the second (experimental) developer, represented by the solid line and illustrating the process of the present invention, initially increased slightly, rising from about 52 to about 65, and subsequently dropped slightly, reaching equilibrium at about 45. These results illustrate the improvement in initial operating stability obtained when the process of the present invention is applied with respect to fresh developer compositions in high-to-low situations.

The above examples are illustrative in nature, and the invention is not limited to these specific embodiments. Those skilled in the art will recognize variations and modifications that may be made which are within the scope of the following claims.

We claim:

1. A process for maintaining the triboelectric stability of an electrophotographic developer composition, comprising:

a. providing a first developer composition comprising first toner particles and virgin carrier particles;

b. determining the tribo product of said first developer composition;

c. providing an aged developer composition by subjecting said first developer composition to at least 5,000 electrophotographic imaging cycles, wherein the tribo product of said aged developer composition is from about 10 to about 200%·μC/g;

d. determining the tribo product of said aged developer composition;

e. providing a second developer composition comprising second toner particles and said virgin carrier particles;

f. incorporating said second developer composition into an electrophotographic imaging device; and g. adding said first toner particles to said device as said second toner particles are depleted by image development; subject to the provisions that the tribo product of said second developer composition is unequal to the tribo product of said first developer composition, that the tribo product of said second developer composition is within 25 tribo product units of the tribo product of said aged developer composition, that the second developer composition exhibits an initial instability opposite to that of the first developer composition, and that the tribo product of said first developer composition and the tribo product of said second developer composition are from about 10 to about 200%·μC/g.

2. A process in accordance with claim 1 wherein the tribo product of said second developer composition is greater than the tribo product of said first developer composition.

3. A process in accordance with claim 1 wherein the tribo product of said second developer composition is less than the tribo product of said first developer composition.

4. A process in accordance with claim 2 wherein said second developer composition has a tribo product within 10 tribo product units of the tribo product of said first developer composition.

5. A process in accordance with claim 3 wherein said second developer composition has a tribo product within 10 tribo product units of the tribo product of said first developer composition.

6. A process in accordance with claim 1 wherein said second toner particles and/or said first toner particles contain, as an external additive, a composition selected from the group consisting of fumed silica, silicon derivatives, ferric oxide, hydroxy terminated polyethylenes, polyolefin waxes, polymethylmethacrylate, zinc stearate, chromium oxide, aluminum oxide, titanium oxide, stearic acid, and polyvinylidene fluorides.

7. A process in accordance with claim 2 wherein said second toner particles and/or said first toner particles contain, as an external additive, a composition selected from the group consisting of fumed silica, silicon derivatives, ferric oxide, hydroxy terminated polyethylenes, polyolefin waxes, polymethylmethacrylate, zinc stearate, chromium oxide, aluminum oxide, titanium oxide, stearic acid, and polyvinylidene fluorides.

8. A process in accordance with claim 3 wherein said second toner particles and/or said first toner particles contain, as an external additive, a composition selected from the group consisting of fumed silica, silicon derivatives, ferric oxide, hydroxy terminated polyethylenes, polyolefin waxes, polymethylmethacrylate, zinc stearate, chromium oxide, aluminum oxide, titanium oxide, stearic acid, and polyvinylidene fluorides.

9. A process in accordance with claim 2 wherein said first toner particles or said second toner particles contain, as an external additive, a composition selected from the group consisting of fumed silica, silicon derivatives, ferric oxide, hydroxy terminated polyethylenes, polyolefin waxes, polymethylmethacrylate, zinc stearate, chromium oxide, aluminum oxide, titanium oxide, stearic acid, and polyvinylidene fluorides.

10. A process in accordance with claim 3 wherein said first toner particles or said second toner particles contain, as an external additive, a composition selected from the group consisting of fumed silica, silicon derivatives, ferric oxide, hydroxy terminated polyethylenes, polyolefin waxes, polymethylmethacrylate, zinc stearate, chromium oxide, aluminum oxide, titanium oxide, stearic acid, and polyvinylidene fluorides.

11. A process in accordance with claim 2 wherein said first toner particles have an average particle diameter of between about 4 and about 14 microns and said second toner particles have an average particle diameter of between about 6 and about 16 microns.

12. A process in accordance with claim 3 wherein said first toner particles have an average particle diameter of between about 6 and about 16 microns and said second toner particles have an average particle diameter of between about 4 and about 14 microns.

13. A process in accordance with claim 1 wherein said first toner particles and said second toner particles both comprise a resin selected from the group consisting of polyesters, polyamides, epoxies, polyurethanes, diolefins, vinyl resins, alkyl acrylate resins, and polymeric esterification products of a dicarboxylic acid and a diol comprising a diphenol.

14. A process in accordance with claim 2 wherein said first toner particles and said second toner particles both comprise a resin selected from the group consisting of polyesters, polyamides, epoxies, polyurethanes, diolefins, vinyl resins, alkyl acrylate resins, and polymeric esterification products of a dicarboxylic acid and a diol comprising a diphenol.

15. A process in accordance with claim 3 wherein said first toner particles and said second toner particles both comprise a resin selected from the group consisting of polyesters, polyamides, epoxies, polyurethanes, diolefins, vinyl resins, alkyl acrylate resins, and polymeric esterification products of a dicarboxylic acid and a diol comprising a diphenol.

16. A process in accordance with claim 1 wherein said virgin carrier particles comprise a material selected from the group consisting of uncoated steel, uncoated nickel, uncoated ferrite, uncoated granular zircon, coated steel, coated nickel, coated ferrite, and coated granular zircon.

17. A process in accordance with claim 2 wherein said virgin carrier particles comprise a material selected from the group consisting of uncoated steel, uncoated nickel, uncoated ferrite, uncoated granular zircon, coated steel, coated nickel, coated ferrite, and coated granular zircon.

18. A process in accordance with claim 3 wherein said virgin carrier particles comprise a material selected from the group consisting of uncoated steel, uncoated nickel, uncoated ferrite, uncoated granular zircon, coated steel, coated nickel, coated ferrite, and coated granular zircon.

19. A process in accordance with claim 2 wherein said second developer composition has a tribo product of from about 130 to about 140%·μC/g and said first developer composition has a tribo product of from about 70 to about 80%·μC/g.

20. A process in accordance with claim 3 wherein said second developer composition has a tribo product of from about 47 to about 57%·μC/g and said first developer composition has a tribo product of from about 70 to about 80%·μC/g.

21. A process in accordance with claim 2 wherein said carrier particles comprise a steel core having with a polymeric coating thereover, said first toner particles comprise about 77.5% by weight of a styrene-butadiene resin, about 4 percent by weight of carbon black, about 18 percent by weight of magnetite, about 0.5 percent by weight of distearyl dimethyl ammonium methyl sulfate, said first developer composition comprises about 96 percent by weight of said carrier particles and about 4 percent by weight of said first toner particles, said second toner particles comprise about 77% by weight of a styrene-butadiene resin, about 4 percent by weight of carbon black, about 18 percent by weight of magnetite, about 1 percent by weight of distearyl dimethyl ammonium methylsulfate and said second developer composition comprises about 96 percent by weight of said carrier particles and about 4 percent by weight of said second toner particles.

22. A process in accordance with claim 21 wherein said carrier particles have a nominal weight median particle diameter of about 125 microns, said polymeric coating comprises polymethylmethacrylate and polyvinylidene fluoride, said first toner particles have an average particle diameter of about 9 microns, and said styrene butadiene resin comprises about 88% by weight styrene and about 12% by weight butadiene.

23. A process in accordance with claim 22 wherein said first developer composition has a tribo product of about 75%·μC/g and said second developer composition has a tribo product of about 132%·μC/g.

24. A process in accordance with claim 3 wherein said carrier particles comprise steel particles having a polymeric coating thereover, said first toner particles comprise about 92 percent by weight of a poly-n-butylmethacrylate resin, about 6 percent by weight of carbon black, and about 2 percent by weight of cetyl pyridinium chloride, said first developer composition comprises about 97 percent by weight of said carrier particles and about 3 percent by weight of said first toner particles, said second toner particles comprise about 92 percent by weight of a poly-n-butylmethacrylate resin, about 6 percent by weight of carbon black, about 2 percent by weight of cetyl pyridinium chloride, and, as an external additive, ferric oxide particles present in an amount of about 3 percent by weight of said second start-up toner particles, and said second developer composition comprises about 97 percent by weight of said carrier particles and about 3 percent by weight of said second toner particles.

25. A process in accordance with claim 24 wherein said carrier particles have a nominal weight median particle diameter of about 130 microns, said polymer coating comprises polymethylmethacrylate and polyvinylidene fluoride, said first toner particles have an average particle diameter of about 11 microns, said poly-n-butylmethyacrylate resin has an average molecular weight of about 68,000, and said second toner particles have an average particle diameter of about 11 microns.

26. A process in accordance with claim 25 wherein said first developer composition has a tribo product of about 85%·μC/g and said second developer composition has a tribo product of about 52%·μC/g.

* * * * *